US006272892B1

(12) United States Patent
Ozaki et al.

(10) Patent No.: US 6,272,892 B1
(45) Date of Patent: Aug. 14, 2001

(54) FORGING PRESS APPARATUS, CONTROLLER OF AUTOMATION DEVICE USED THEREFOR AND SHUT HEIGHT CONTROLLER

(75) Inventors: Yutaka Ozaki, Uma-gun; Masashi Tado, Iyomishima; Ryoichi Yamada, Niihama; Hironobu Noguchi, Shuusou-gun, all of (JP)

(73) Assignee: Sumitomo Heavy Industries, Ltd., Tokyo (JP)

( * ) Notice: Subject to any disclaimer, the term of this patent is extended or adjusted under 35 U.S.C. 154(b) by 0 days.

(21) Appl. No.: 09/528,170

(22) Filed: Mar. 17, 2000

(30) Foreign Application Priority Data

Mar. 19, 1999 (JP) ..... 11-074766
Sep. 8, 1999 (JP) ..... 11-253848

(51) Int. Cl.[7] ..... B21D 55/00

(52) U.S. Cl. ..... 72/4; 72/21.3; 72/21.4; 72/342.1; 72/405.01; 72/446

(58) Field of Search ..... 72/405.01, 19.5, 72/20.5, 21.1, 21.3, 21.4, 4, 446, 342.1; 100/257

(56) References Cited

U.S. PATENT DOCUMENTS 4,918,956 * 4/1990 Schoch ..... 72/21.1
5,000,021 * 3/1991 Nakamura ..... 72/19.5
5,140,834 * 8/1992 Kashiwagi ..... 72/446
5,379,688 * 1/1995 Ishii ..... 100/257
5,915,293 * 6/1999 Welsh ..... 100/257
5,934,125 * 8/1999 Takayama ..... 71/1

FOREIGN PATENT DOCUMENTS 59-107732 * 6/1984 (JP) ..... 72/405.01

* cited by examiner

*Primary Examiner*—Daniel C. Crane
(74) *Attorney, Agent, or Firm*—Arent Fox Kintner Plotkin & Kahn, PLLC

(57) ABSTRACT

To provide a controller of an automation device in a forging press capable of preventing the occurrence of a phenomenon in which raw materials are progressively transported in a partially lacked state and enhancing forging accuracy productivity, an inlet side transportation device includes a raw material detector for detecting whether a raw material to be supplied to a transfer feeder has been supplied or not and a controller for controlling the feed operation of the transfer feeder. When the controller receives a detection signal indicating that the raw material has supplied from the detector, the controller causes the transfer feeder to perform an ordinary feed operation, whereas when the controller does not receive the detection signal from the detector, the controller temporarily stops the transfer feeder at a waiting position, and when the controller receives a detection signal of a raw material supplied next within the set time of the temporary stop, the controller starts the transfer feeder, whereas when the controller does not receive the detection signal of the raw material within the set time, the controller starts the transfer feeder simultaneously with the finish of the set time.

5 Claims, 12 Drawing Sheets

FORGING PRESS APPARATUS, CONTROLLER OF AUTOMATION DEVICE USED THEREFOR AND SHUT HEIGHT CONTROLLER

BACKGROUND OF THE INVENTION

1. Field of the Invention

The present invention relates to a forging press apparatus for press forging a raw material, a controller of an automation device used therefor, and a shut height controller. More particularly, the present invention relates to a device for preventing the reduction of productivity caused by out of coincidence of the synchronism between the production tempo of a heating furnace and that of an automation device for supplying a raw material to a forging press in a forging press line, and to a device for adjusting a shut height.

2. Description of the Related Art

A load controller for enhancing the accuracy of a product thickness is conventional proposed in an automatic mechanical forging press apparatus (refer to Registered Utility Model No. 2534472 and Japanese Unexamined Patent Publication (JP-A) No. 7-47500, hereinafter, referred to as Conventional Arts 1 and 2).

The shut height controller according to Conventional Art 1 is included in a forging press apparatus for forging raw materials to forged products by continuously striking them in die components.

The shut height controller includes a measuring unit for obtaining a measured striking load by continuously measuring a striking load in the state that a raw material is located in die components. The measuring unit has load sensors disposed on the support columns of a cabinet and a load converter for calculating a die-kiss load from the output from the load sensor and outputting it.

Further, the shut height controller has an adjustment unit. The adjustment unit compares a reference striking load predetermined by a CPU with the measured striking load from the load converter and determines the deviation therebetween. When the deviation exceeds a predetermined allowable value, the adjustment unit outputs a hydraulic motor drive command to a hydraulic motor based on a shut height correction value corresponding to the deviation and adjusts a shut height.

Further, the crank press apparatus disclosed in Conventional Art 2 includes a lower die component disposed on a bed and an upper die component mounted on a slide and moves the slide upward and downward by a crank mechanism. The crank press apparatus includes abutment surfaces disposed in the vicinity of both the upper and lower die components in addition thereto. The abutment surfaces are abutted against each other before the upper and lower die components are completely closed when the slide is moved downward. In addition, the abutment surfaces are arranged such that the striking load of a press is set larger than a load necessary to forging and the striking load of the press is controlled by causing the abutment surfaces to be abutted against each other in a forging operation to thereby secure the accuracy of the thickness of a product.

At present, however, the measures for the enhancement of accuracy of the thickness of a product in the forging press apparatuses employed in Conventional Arts 1 and 2 can only cope with the frequent change of striking conditions, which are required by the recent increase of operating speed of equipment, as the premise of the enhancement of the accuracy at the best and cannot cope with the enhancement of the accuracy of thickness of the product which is intrinsically required.

As a specific example, when certain predetermined conditions are set in a press, that is, when, for example, such conditions that raw materials to be forged are supplied to all the processes in the press and all of them are to be struck, all the raw materials are always struck conventionally. However, there may be a case in which some of the raw materials to be forged temporarily lack in some processes due to the difference between the production tempo of a heating furnace and that of a forging press main body. In particular, when the speed of equipment is more increased, this phenomenon frequently occurs.

In such a case, the thickness of a product cannot be controlled by the feed-back of a load and a total load is dispersed, whereby the accuracy of the thickness of forged products is deteriorated. As a result, when some raw materials to be forged lack, the accuracy of a product thickness cannot be enhanced in total.

As described above, it is conventionally difficult to perfectly synchronize the cycle time of a heating furnace with that of the automation device (for example, a transfer feeder) of a forging press in a forging press line. The reasons are as described below.

In general, a heating furnace adjusts the production tempo of by the feed speed of a billet. The billet feed mechanism of the heating furnace is generally arranged such that the billet is clamped between upper and lower gears and the gears are rotated. Thus, the feed speed of the billet is determined by controlling the number of revolution of the gears. Therefore, when the billet slips between the gears, when an end surface of the billet is obliquely cut or the billet has burrs formed thereon, intervals exist sometimes and do not exist sometimes between billets, whereby actual production tempos are varied. Because of the above reason, it is difficult to establish perfect synchronization between the heating furnace and the forging press.

When the heating furnace is not in synchronization with the forging press, the following problems arise.

(i) When the production tempo of the heating furnace is faster than that of the transfer feeder, the number of billets supplied from the heating furnace is larger than the throughput of the forging press. As a result, an abnormal state is caused in the transfer of billets between the heating furnace and the forging press or a rate of operation is lowered or rejected products (defective products) are increased because billets are rejected, whereby productivity is lowered.

(ii) When the production tempo of the heating furnace is slower than that of the forging press, the number of billets supplied from the heating furnace is smaller than the throughput of the forging press. Thus, billets lack in some of the multi-process die components in the forging press. Therefore, since a total forging load is varied, the accuracy of thickness of forged products is deteriorated and accordingly products of defective accuracy are made and productivity is lowered thereby.

However, since the adjustment method shown in the above item (i) permits the generation of rejected products from the beginning of the execution of the method, the adjustment by which productively is lowered is not practically usable and is not employed.

Therefore, in many cases, adjustment is carried out such that the production tempo of the heating furnace is made somewhat slower than that of the transfer feeder as shown in the item (ii). Thus, there is caused a phenomenon that raw materials partly lack in a synchronized state.

The phenomenon of the partly lack of raw materials will be described below in detail. It is supposed that all the raw materials are struck in the four processes of a forging press at the production tempo in which a cycle time is set to 3 seconds (productivity; 1200 pieces/hour). All the raw materials striking is one of transfer methods in the production performed by press by which raw materials to be forged, which are located in all the processes (from first to fourth processes) in multi-process die components, are forged at a time by one press stroke and transported.

In the above case, while the transfer feeder of the forging press operates at a cycle of 3 seconds, billets are supplied from the heating furnace at a little longer cycle time because of the above reason.

When the slight deviation between the cycle times is accumulated to 1 cycle time, the phenomenon of the partly lack of raw materials is caused. Specifically, the raw materials, which were forged and produced in all the first to fourth process of the forging press, are forged in only the second to fourth processes excluding the first process. When the lack of raw material in the first process occurs once, forging is carried out only in the first, third and fourth processes excluding the second process in the next cycle. Then, the lack of raw material sequentially occurs in the third process and the fourth process.

It is supposed that the deformation of a press is 2 mm and the thickness of a product is 25 mm with a forging load of 2000 tf (tons) when forging is carried out in all the processes. When the partial lack of raw material occurs in the above state, the load of the forging process in which the partial lack of raw material occurs is subtracted, for example, when there is a forging load of 1000 tf in the third finish process, a load as large as 1000 tf is lost so that the deformation of the press is made to 1 mm which is half the original deformation and the thickness of the product is made to 24 mm.

A "load controller for automatic mechanical forging press" is proposed in Japanese Examined Patent Publication (JP-B) No. 6-77878 (referred to as Conventional Art 3) as a slide adjustment mechanism for solving the above problem.

The automatic mechanical forging press shown in Conventional Art 3 comprises a forging press section, which is composed of a plurality of upper die components mounted in a row on the lower bottom of a slide suspended from an eccentric shaft through a connecting rod so that it can be freely moved up and down and lower die components disposed in parallel with each other on the upper surface of a bed confronting the upper die components and a transfer section for supplying raw materials to be forged and sequentially transferring them to each process and taking out forged products.

The automatic mechanical forging press includes a forged product detection unit for detecting whether or not raw materials or forged semi-products exist in the respective die components, an arithmetic operation and control unit for issuing a prestored additional supply execution command in response to the detection signal from the forged product detection unit, and an actuating unit for rotating an adjust lever which is eccentrically fitted on a lift pin inserted into a connecting rod at the lower portion thereof by a desired angle by hydraulic force in response to the execution command so as to move the position of a lower dead point.

However, there is a limit in the adjustment of the slide at a high speed also in Conventional Art 3, and further there is also a problem in that frequent actuation of the slide is not good from the view point of durability. Thus, Conventional Art 3 is not used as a countermeasure for the partial lack of raw materials.

SUMMARY OF THE INVENTION

It is an object of the present invention to provide a forging press apparatus which includes both a partial lack of raw materials preventing function and a product thickness control function which is achieved by load control.

It is another object of the present invention to provide a controller capable of securing stable product accuracy and enhancing productivity by overcoming a drawback caused by the deviation of synchronization between the production tempo of a heating furnace and the automation device of a forging press in a forging press apparatus.

It is still another object of the present invention is to provide a simply arranged shut height controller capable of obtaining a forged product of high accuracy from the beginning of striking and accurately adjusting a shut height.

According to one aspect of the present invention, there is provided a forging press apparatus which includes a forging press section, an automation means for supplying a raw material to the forging press section, and an inlet side transportation device for transporting the raw material heated by a heating furnace to the automation means. In the forging press apparatus, the inlet side transportation device comprises a raw material detector for detecting whether the raw material to be supplied to the automation means has been supplied or not and a controller for controlling the feed operation of the automation means. When the controller receives a detection signal indicating that the raw material is supplied from the detector, the controller causes the automation means to perform an ordinary feed operation, whereas when the controller does not receive the detection signal from the detector, the controller temporarily stops the automation means at a waiting position. When the controller receives a detection signal of a raw material supplied next within the set time of the temporary stop, the controller starts the automation means, whereas when the controller does not receive the detection signal of the raw material within the set time, the controller starts the automation means simultaneously with the finish of the set time.

According to another aspect of the present invention, there is provided a controller of an automation means in a forging press apparatus which includes a forging press section, the automation means for supplying a raw material to the forging press section, and an inlet side transportation device for transporting the raw material heated by a heating furnace to the automation means. In the controller, the inlet side transportation device comprises a raw material detector for detecting whether the raw material to be supplied to the automation means has been supplied or not and the controller for controlling the feed operation of the automation means. When the controller receives a detection signal indicating that the raw material is supplied from the detector, the controller causes the automation means to perform an ordinary feed operation, whereas when the controller does not receive the detection signal from the detector, the controller temporarily stops the automation means at a waiting position. When the controller receives a detection signal of a raw material supplied next within the set time of the temporary stop, the controller starts the automation means, whereas when the controller does not receive the detection signal of the raw material within the set time, the controller starts the automation means simultaneously with the finish of the set time.

According to still another aspect of the present invention, there is provided a shut height controller of a forging press apparatus which includes a forging press section for forging a raw material to a forged product by continuously forging the raw material by die components, an automation means for supplying the raw material to the forging press section, and an inlet side transportation device for transporting the raw material heated by a heating furnace to the automation means. In the shut height controller, the forging press section comprises a shut height means for controlling the thickness of the forged product. The shut height control means comprises a measurement means for obtaining a measured striking load by continuously measuring a striking load in the state that the raw material is charged into the die components and an adjustment means for comparing a predetermined reference striking load with the measured striking load and determining a deviation therebetween, and also adjusting a shut height based on a shut height correction value corresponding to the deviation when the deviation exceeds a predetermined allowable value.

DESCRIPTION OF THE PREFERRED EMBODIMENTS

Before the description of the embodiments of the present invention, Conventional Arts will be explained with reference to FIGS. 1 to 3 for the better understanding of the present invention.

Figure 1:
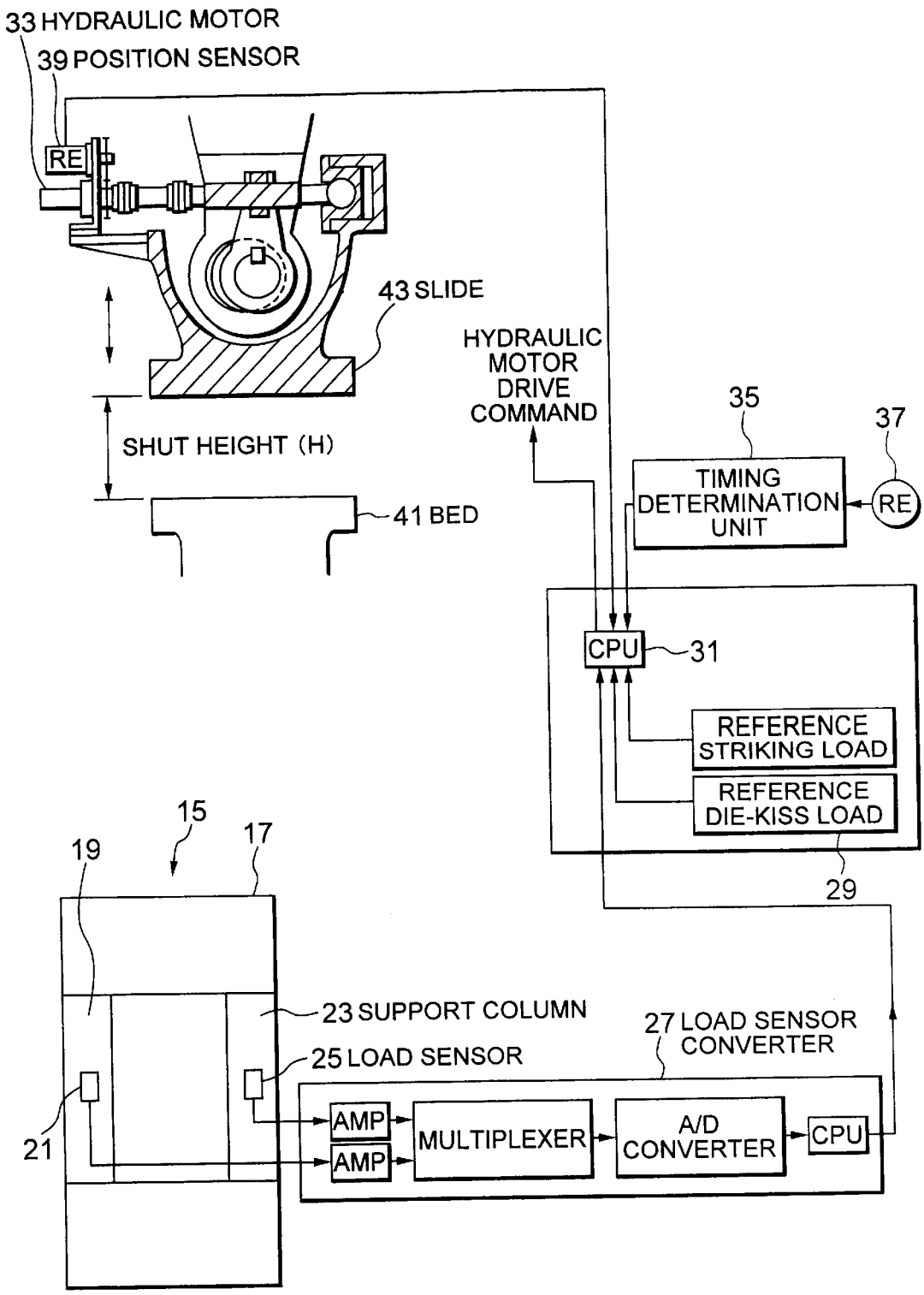
FIG. 1 PRIOR ART
FIG. 1 is a view showing a shut height controller of a forging press disclosed in Conventional Art 1.

Referring top FIG. 1, the shut height controller of the forging press disclosed in Conventional Art 1 is disposed to a forging press apparatus 15 for forging a raw material to a forged product by performing continuous striking using die components.

The shut height controller includes a measuring unit for obtaining a measured striking load by continuously measuring a striking load while a raw material is located in the die components. The measuring unit is composed of load sensors 23 and 25 disposed on the support columns 19 and 21 of a cabinet 17 and a load converter 27 for calculating a die-kiss load from the outputs from the load sensors and supplying them.

Further, the shut height controller includes an adjustment unit 29. The adjustment unit 29 compares a reference striking load predetermined by a CPU 31 with the measured stamping load from the load converter and determines the deviation therebetween. When the deviation exceeds a predetermined allowable value, the adjustment unit 29 supplies a hydraulic motor drive command to a hydraulic motor 33 based on a shut height correction value corresponding to the deviation, thereby adjusting a shut height.

Figure 2:
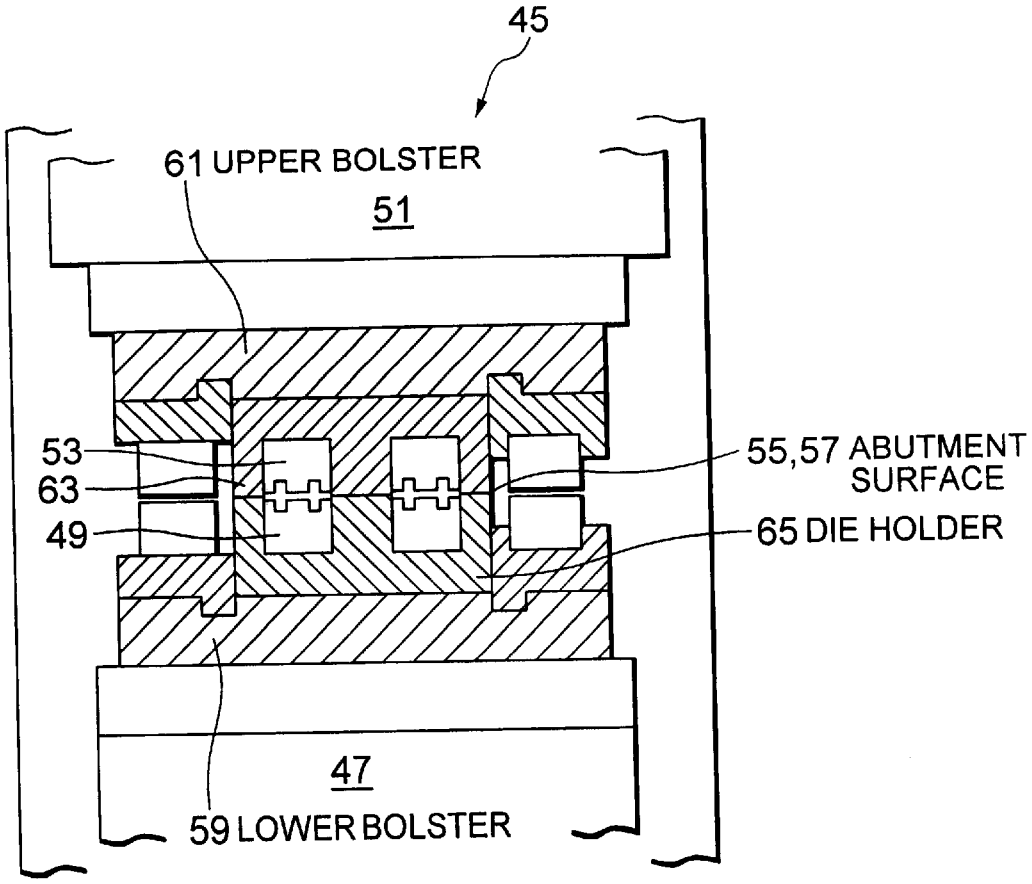
FIG. 2 PRIOR ART
FIG. 2 is a sectional view showing a crank press apparatus disclosed in Conventional Art 2.

Referring to FIG. 2, the crank press apparatus 45 according to Conventional Art 2 includes lower die components placed on a bed 47 and upper die components mounted on a slide 51 and lifts and lowers the slide 51 by a not shown crank mechanism.

In the crank press apparatus 45, abutting surfaces 55 and 57 are disposed in the vicinity of the lower die components 49 and the upper die components 53 independently therefrom. The abutting surfaces 55 and 57 are abutted against each other before the upper and lower die components 49 and 53 are completely closed when the slide 51 is lowered. The crank press apparatus 45 is arranged such that the striking load of a press is set larger than a load necessary to forging and the accuracy of the thickness of a product is secured by controlling the striking load of the press by causing the abutting surfaces to be abutted against each other in a forging operation.

Figure 3:
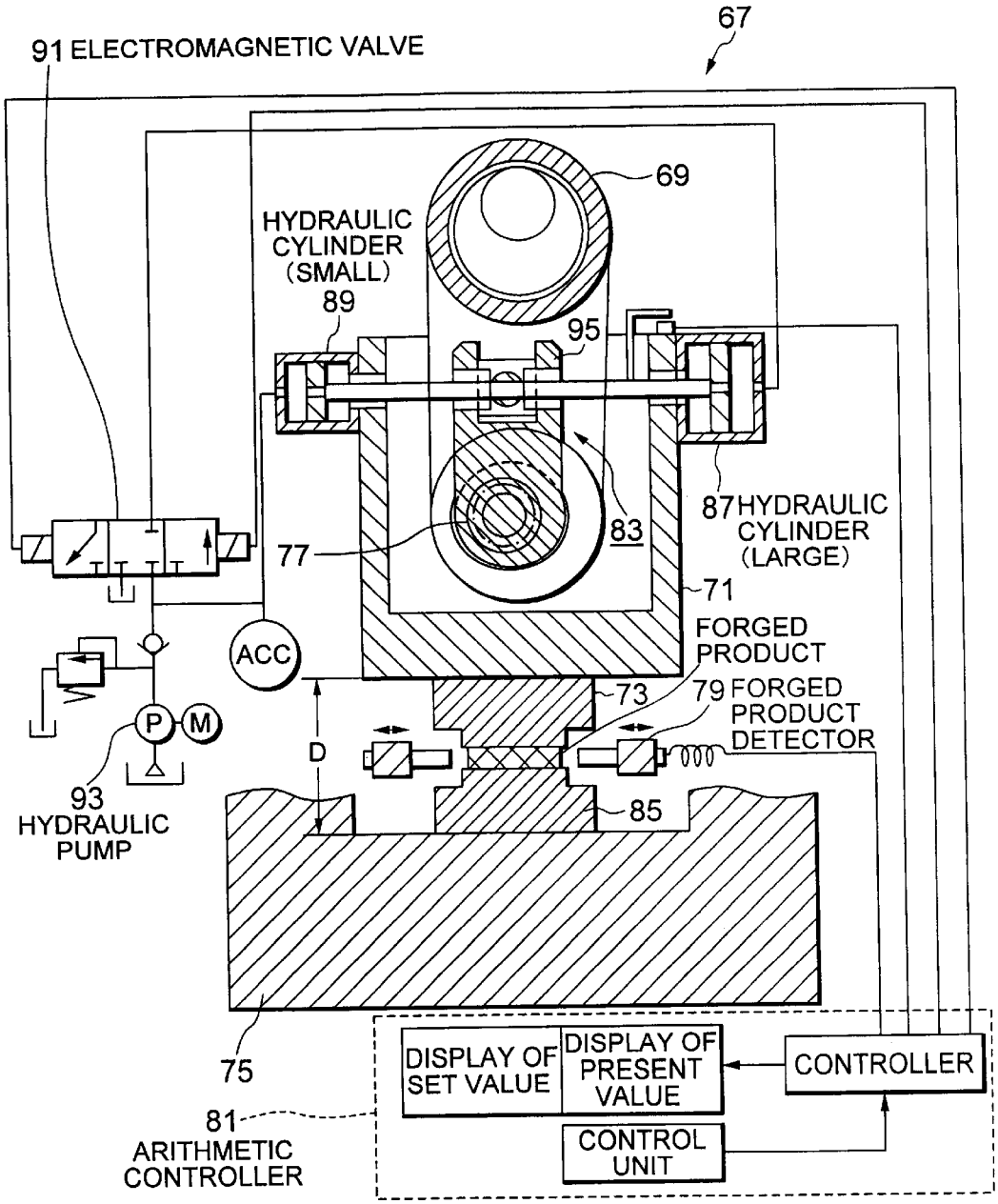
FIG. 3 PRIOR ART
FIG. 3 is a viewshowing the schematic arrangement of a load controller shown in Conventional Art 3.

Referring to FIG. 3, the automatic mechanical press apparatus 67 shown in Conventional Art 3 comprises a forging press section, which is composed of a plurality of upper die components 73 mounted in a row on the lower bottom of a slide 71 suspended from an eccentric shaft through a connecting rod 69 so that it can be freely moved up and down and lower die components 77 disposed in parallel with each other on the upper surface of a bed 75 confronting the upper die components 73 and a transfer section for supplying raw materials to be forged and sequentially transferring them to each process and taking out forged products.

The automatic mechanical forging press includes a forged product detection unit 79 for detecting whether or not raw materials or forged semi-products exist in the respective die components, an arithmetic operation and control unit 81 for issuing a prestored additional supply execution command in response to the detection signal from the forged product detection unit 79, and an actuating unit for rotating an adjust lever 83 which is eccentrically fitted on a lift pin 77 inserted into a connecting rod 69 at the lower portion thereof by a desired angle by hydraulic force in response to the execution command so as to move the position of a lower dead point.

Next, the embodiments of the present invention will be described with reference to FIGS. 4 to 13A and 13B.

(First Embodiment)

Figure 4:
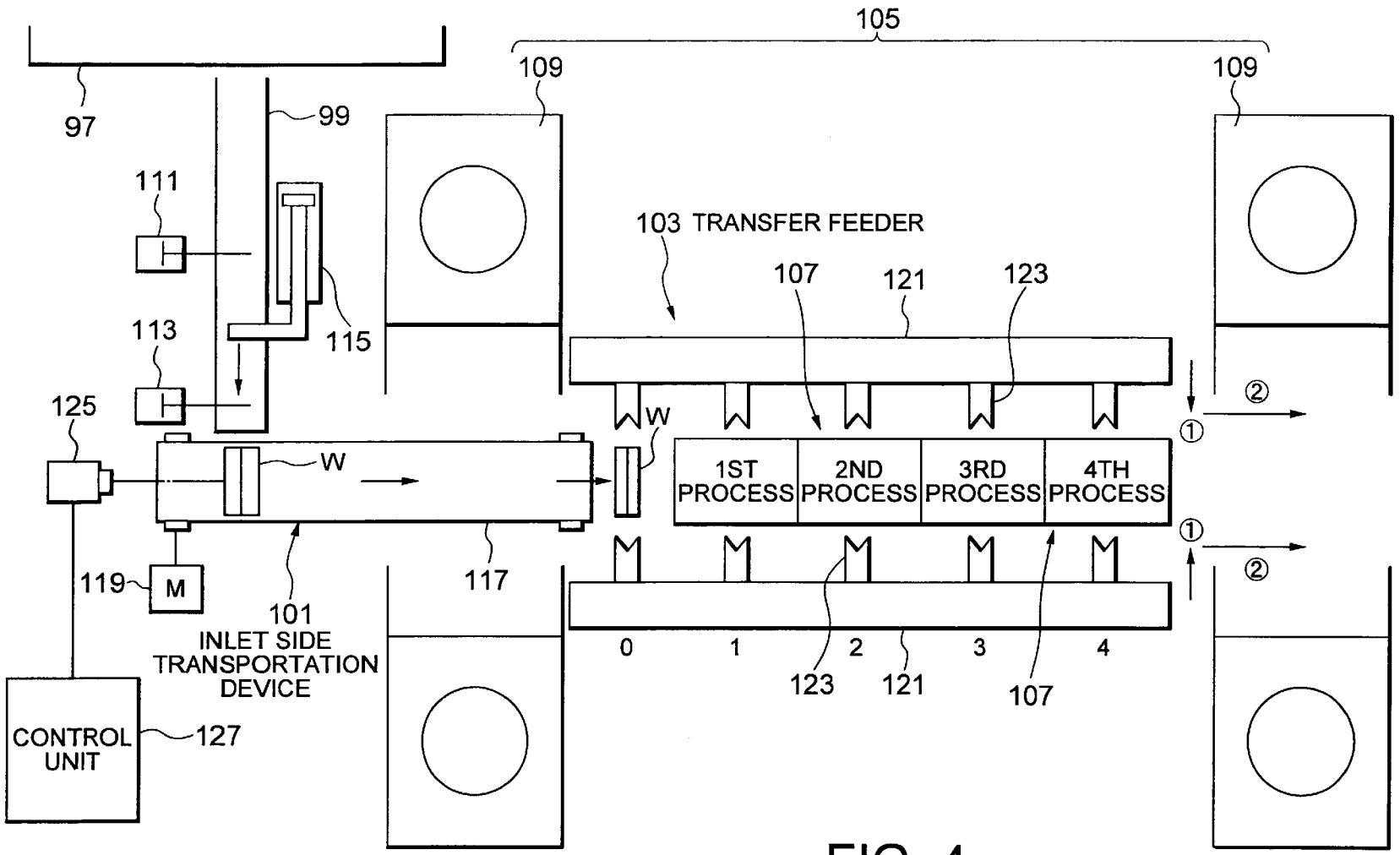
FIG. 4 is a block diagram of a forging press line according an embodiment 1 of the present invention.

In FIG. 4, numeral 97 denotes a heating furnace such as an induction heater or the like for heating a raw material, and numeral 99 denotes a transportation conveyer for transporting a heated raw material from the heating furnace 97 to an inlet side transportation device 101 which will be described later. The inlet side transportation device 101 supplies the raw material to a transfer feeder 103 to be described later in detail. The transfer feeder 103 is one of automation devices for sequentially feeding the raw material between the multi-process die components in a forging press section 105 which will be described later in detail. Numeral 109 denotes the frame of the forging press section 105. Note that the raw material W is a material to be forged having a square cross section. While many of the raw material W are long billets, short billets are also included in the concept of the raw material W.

The above transportation conveyer 99 includes stoppers 111 and 113 and pusher 115 attached thereto. The alternate actuation of the stoppers 111 and 113 provides a timing at which the raw materials W are supplied so that they are supplied to the inlet side of the inlet side transportation device 101 by the pusher 115.

The above inlet side transportation device 101 is a known device in which an endless belt 117 is driven by a motor 119.

The above transfer feeder 103 is a known feeder arranged such that a plurality of (for example, each 5 pieces) catching detents 123 are mounted on two feed rods 121 and 121 disposed in parallel with each other for the transportation of the raw materials W. The five pairs of catching detents 123 correspond to a zero process where a raw material is delivered to die components before first and fourth press working processes of the forging press.

Figure 5:
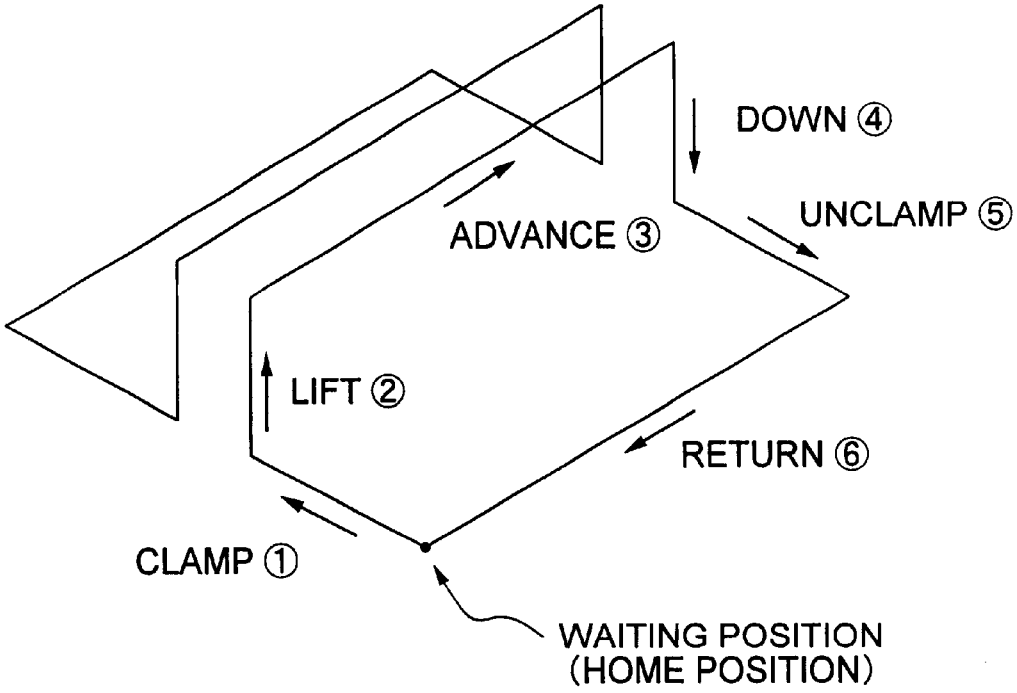
FIG. 5 is a view explaining the operation of a transfer feeder according to the first embodiment of the present invention.

As shown in FIG. 5, in the transfer feeder 103, the two feed rods 121 and 121 are actuated in the sequence of clamp (1)→lift (2)→advance (3)→down (4)→unclamp (5)→return (6) so that the raw materials W are sequentially fed from the zero process to a first process die component, to a second process die component therefrom, to a third process die component therefrom and to a fourth process die component therefrom. Note that start point of the clamp (1) operation, that is, the reaching point of the return (6) operation is a waiting position (home position).

The above components are common to known press lines.

In FIG. 4, numeral 125 denotes a raw material detector for detecting that the raw material W has been supplied to the inlet side of the inlet side transportation device 101. The raw material detector 125 is composed of, for example, a known hot metal detector or the like which detects a temperature higher than a set value.

Numeral 127 denotes a controller which receives a detection signal from the raw material detector 125 and issues an operation command signal to the transfer feeder 103 and is composed of an information processing device such as a known microcomputer or the like.

The controller 127 performs the following control operations.

(1) When the controller 127 receives a detection signal indicating that a raw material has been supplied from the raw material detector 125, it causes the transfer feeder 103 to perform an ordinary feed operation.

(2) When the controller 127 does not receive a detection signal from the raw material detector 125, it temporarily stops the transfer feeder 103 at a waiting position.

(i) When the controller 127 receives the detection signal of a raw material supplied next within the set time of the temporary stop, it starts the transfer feeder 103, (ii) otherwise it starts the transfer feeder 103 simultaneously with the finish of the set time.

Figure 6:
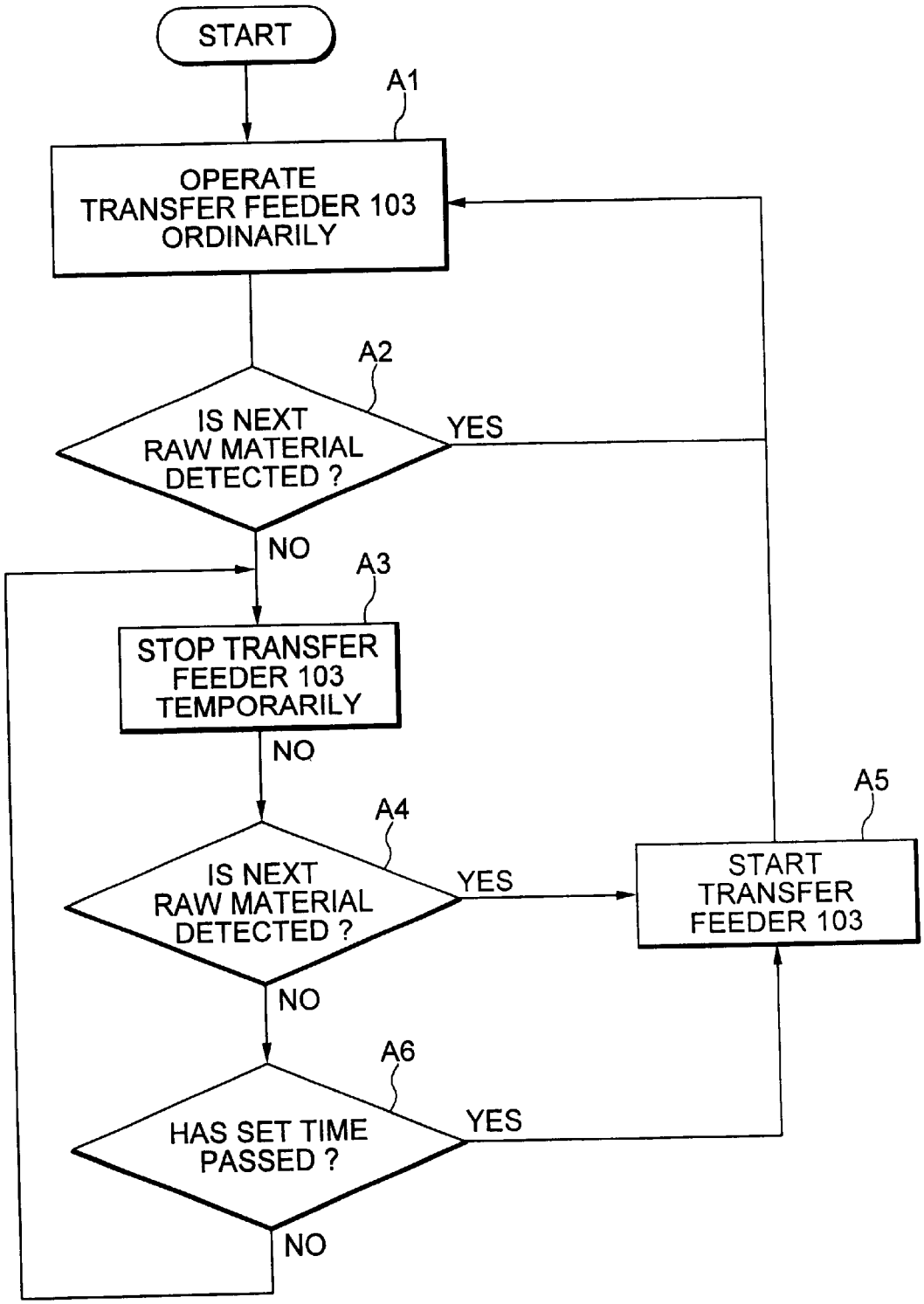
FIG. 6 is a flowchart of the control operation in a controller according to the first embodiment of the present invention.

Next, the above control method will be described in detail with reference to the flowcharts of FIG. 6.

(1) Ordinarily, the raw materials W are sequentially supplied to the inlet side transportation device 101 and the transfer feeder 103 supplies them to the forging press section 105 in synchronization with the press operation thereof. During that time, the transfer feeder 103 repeats an ordinary transfer operation (step A1).

(2) When the raw material detector 125 cannot detect the raw material W on the inlet side of the inlet side transportation device 101 (step A2; NO), the controller 127 temporarily stops the transfer feeder 103 at the waiting position (step A3).

(i) During the set time of the temporary stop, the next raw material W is supplied to the inlet side of the inlet side transportation device 101, and when the raw material detector 125 detects it (step A4; YES), the controller 127 starts the transfer feeder 103 (step A5). In this case, since the raw materials W are supplied to the forging press section 105 without the partial lack thereof, production is not obstructed. In short, the press operation can be normally carried out even if the supply of the raw materials is somewhat delayed so long as the delay is not out of the operation timing of the forging press section 105.

(ii) Next, when the next raw material W is not supplied to the inlet side of the inlet side transportation device 101 within the set time of the temporary stop, it is contemplated that a final billet has been supplied for the completion of production or an abnormal state arises in the inlet side transportation equipment upstream of the forging press section 105. In this case, when the set time passes without the issue of a detection signal (step A6), the transfer feeder 103 is started at the time. Since the position of the final raw material W when the production is finished can be represented by a pattern, it may be possible not to make a defective product by the adjustment of a shut height. However, in the embodiment, the control operation is not carried out at the start of operation before the raw material W is charged into the die component on the front side of multi-process die components 107 and at the time the operation is finished.

As described above, according to the first embodiment of the present invention, when the supply of a raw material to the inlet side transportation device is delayed due to the deviation between the cycle time of the heating furnace and that of the forging press, the transfer feeder is temporarily stopped so as to prevent the partial lack of raw materials between the multi-process die components in the forging press, whereby the reduction of productivity and the occurrence of defective products can be minimized. In other words, in the first embodiment of the present invention, even if the cycle of the heating furnace is a little badly synchronized with the cycle of the forging press, the partial lack of raw materials can be prevented and productivity can be enhanced.

(Second Embodiment)

Figure 7:
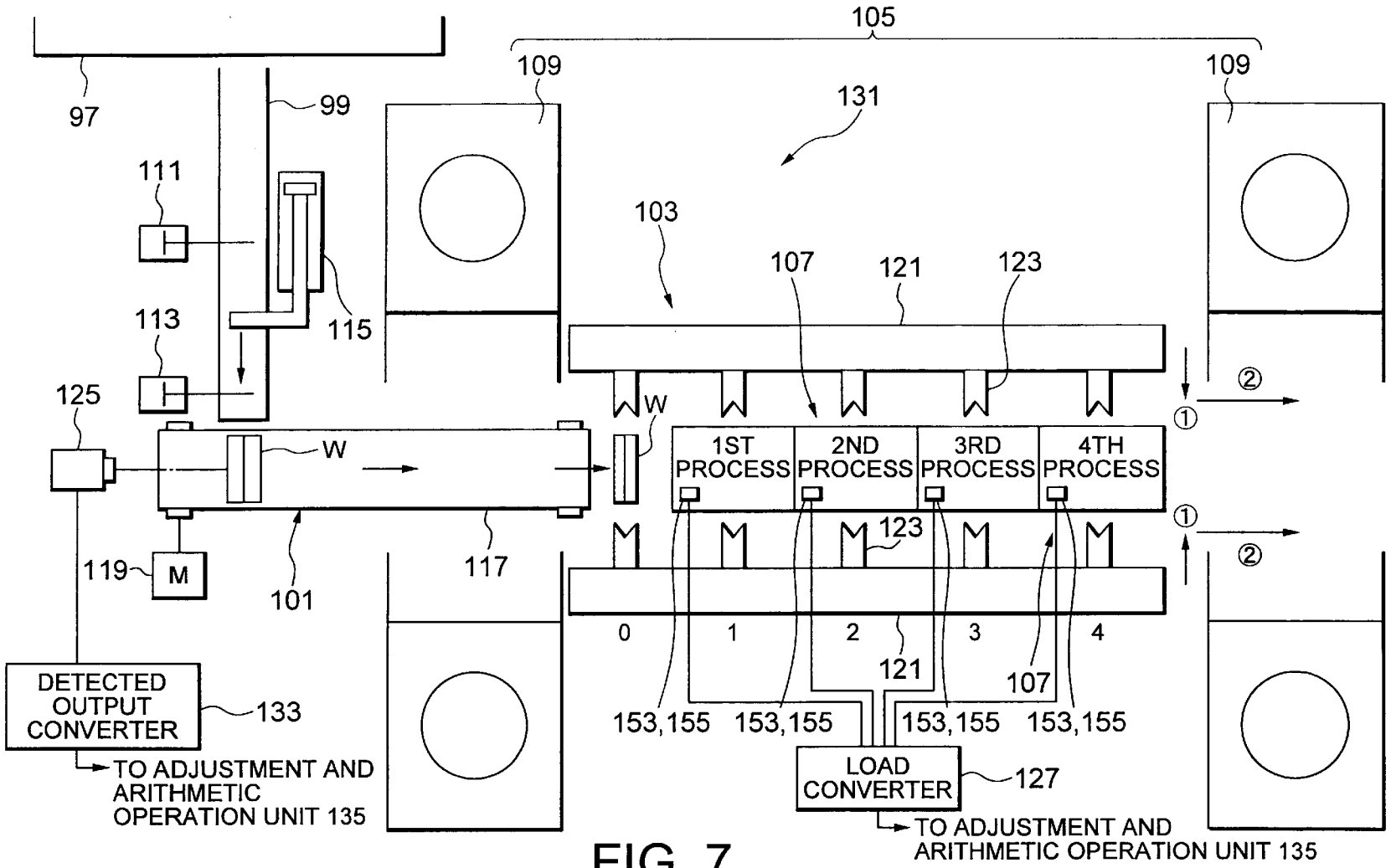
FIG. 7 is a block diagram of the line of a forging press line according to a second embodiment of the present invention.

Next, a second embodiment of the present invention will be described with reference to FIGS. 7 to 13A and 13B. In FIG. 7, the same components as those, in FIG. 4 are denoted by the same numerals.

Figure 8:
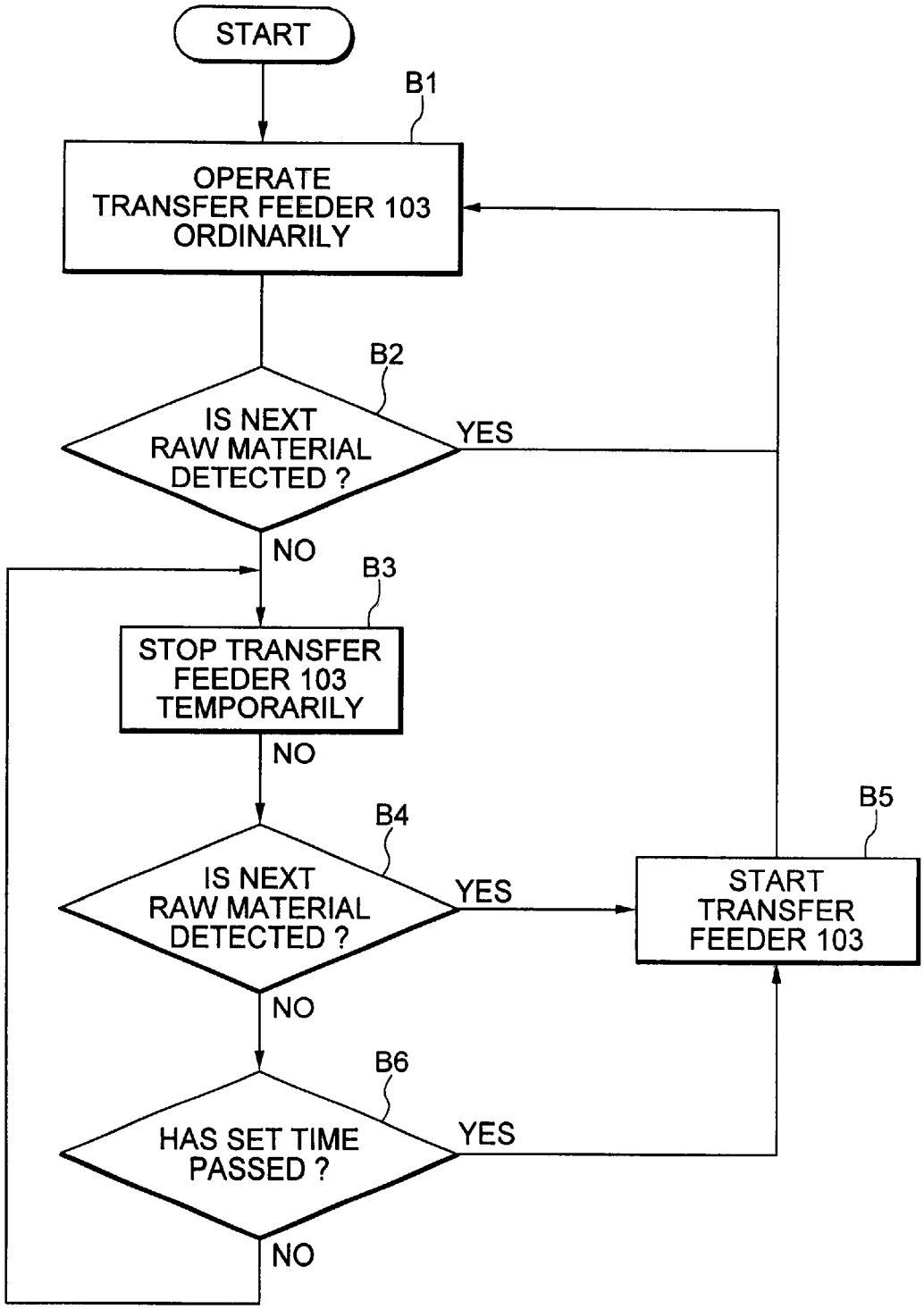
FIG. 8 is a flowchart of the control operation of the forging press apparatus according to the second embodiment of the present invention.

Referring to FIGS. 7 and 8, a forging press apparatus 131 according to the second embodiment of the present invention includes a heating furnace 97 such as an induction heater or the like for heating a raw material, a transportation conveyer 99 for transporting the raw material heated by the heating furnace 97 therefrom, an inlet side transportation device 101 for supplying the transported raw material to a forging press section 105, the forging press section 105 for forging the raw material and a transfer feeder 103 as one of automation devices for sequentially feeding the raw material from the inlet side transportation device 101 in the forging press section 105 and a multi-process die components 107 for press forging the raw material fed from the transfer feeder 103 disposed in the forging press section 105.

The forging press section 105 includes a frame 109 at the outer periphery thereof.

Note that the raw material W is a material to be forged having a square cross section. While many of the raw material W are long billets, short billets are also included in the concept of the raw material W.

The transportation conveyer 99 includes stoppers 111 and 113 and pusher 115 attached thereto. The alternate actuation of the stoppers 111 and 113 provides a timing at which the raw materials W are supplied so that they are supplied to the inlet side of the inlet side transportation device 101 by the pusher 115.

The above inlet side transportation device 101 is a known device in which an endless belt 117 is driven by a motor 119.

The above transfer feeder 103 is a known feeder, likewise the transfer feeder shown in FIGS. 4 and 5, arranged such that a plurality of (for example, each 5 pieces) catching detents 123 are mounted on two feed rods 121 and 121 disposed in parallel with each other for the transportation of the raw materials W. The five pairs of catching detents 123 correspond to a zero process where a raw material is delivered to die components before first and fourth press working processes of the forging press.

As shown in FIG. 5, in the transfer feeder 103, the two feed rods 121 and 121 are actuated in the sequence of clamp (1)→lift (2)→advance (3)→down (4)→unclamp (5)→return (6) so that the raw materials W are sequentially fed from the zero process to a first process die component, to a second process die component therefrom, to a third process die component therefrom and to a fourth process die component therefrom. Note that start point of the clamp (1) operation, that is, the reaching point of the return (6) operation is a waiting position (home position).

The above components are common to known press lines.

Referring to FIG. 7 again, a raw material detector 125 is disposed in the vicinity of an end of the inlet side transportation device 101. The raw material detector 125 detects that the raw material W has been supplied to the inlet side of the inlet side transportation device 101 and outputs the detection signal thereof to a detected output converter 133. The raw material detector 125 is composed of, for example, a known hot metal detector or the like which detects a temperature higher than a set value.

Further, the detected output converter 133 receives the detection signal from the raw material detector 125 and converts it into a digital signal. As described in detail with reference to FIG. 9, the digital signal from the detected output converter 133 is supplied to an adjustment and arithmetic operation unit 135. The feed operation controller 137 of the adjustment and arithmetic operation unit 135 is a device for issuing an operation command signal to the transfer feeder 103 in response to the digital signal from the detected output converter 133 and composed of an information processing unit (CPU) such as a known microcomputer or the like.

The feed operation controller 137 disposed to the adjustment and arithmetic operation unit 135 performs the following control operations.

First, when the feed operation controller 137 receives a detection signal indicating that a raw material has been supplied from the raw material detector 125 through the detected output converter 133, it causes the transfer feeder 103 to perform an ordinary feed operation.

In contrast, when the feed operation controller 137 does not receive a detection signal from the raw material detector 125, it temporarily stops the transfer feeder 103 at a waiting position. When the feed operation controller 137 receives the detection signal of a raw material supplied next within the set time of the temporary stop, it starts the transfer feeder 103, otherwise it starts the transfer feeder 103 simultaneously with the finish of the set time.

Next, the control method of the feed operation controller 137 will be described in detail with reference to the flowcharts of FIG. 8.

Ordinarily, the raw materials W are sequentially supplied to the inlet side transportation device 101 and the transfer feeder 103 supplies them to the forging press section 105 in synchronization with the press operation thereof. During that time, the transfer feeder 103 repeats an ordinary transfer operation (step B1).

When the raw material detector 125 cannot detect the raw material W on the inlet side of transportation device 101 (step B2; NO), the feed operation controller 137 temporarily stops the transfer feeder 103 at the waiting position (step B3).

During the set time of the temporary stop, the next raw material W is supplied to the inlet side of the inlet side transportation device 101, and when the raw material detector 125 detects it (step SA4; YES), the feed operation controller 137 starts the transfer feeder 103 (step B5). In this case, since the raw materials W are supplied to the forging press section 105 without lack, production is not obstructed. In short, the press operation can be normally carried out even if the supply of the raw materials is somewhat delayed so long as the delay is not out of the operation timing of the forging press section 105.

Next, when the next raw material W is not supplied to the inlet side of the inlet side transportation device 101 within the set time of the temporary stop, it is contemplated that a final billet has been supplied for the completion of production or an abnormal state arises in the inlet side transportation equipment upstream of the forging press section 105. In this case, when the set time passes without the issue of a detection signal (step B6), the transfer feeder 103 is started at the time. The transfer feeder 103 is started at the time. Since the position of the final raw material W when the production is finished can be represented by a pattern, it may be possible not to make a defective product by the adjustment of a shut height. However, in the embodiment, the control operation is not carried out at the start of operation before the raw material W is charged into the die component on the front side of a multi-process die component 107 and when the operation is finished.

Figure 9:
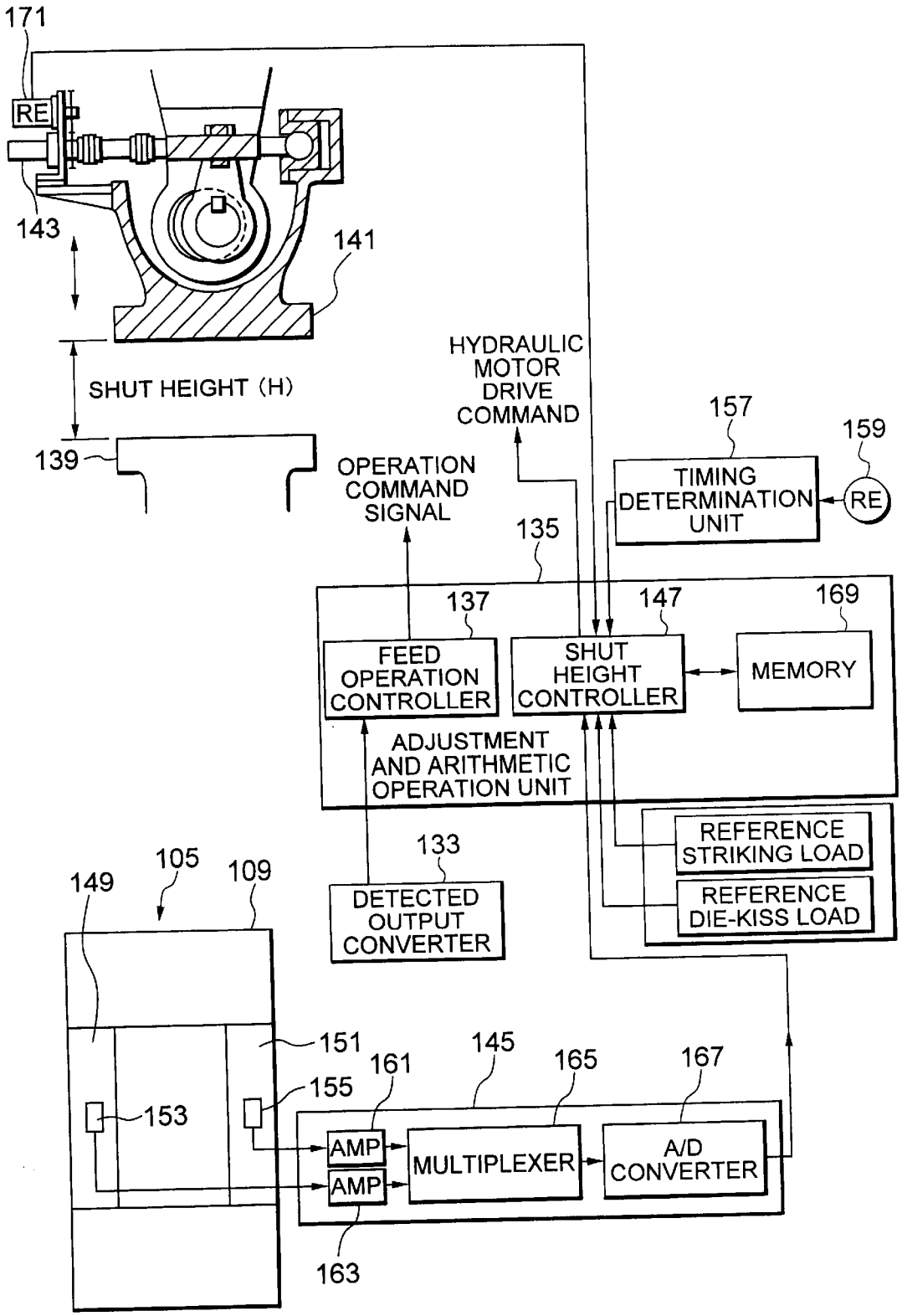
FIG. 9 Is a block diagram mainly showing the forging press section of the forging press apparatus according to the second embodiment of the present invention.

Referring to FIG. 9, the forging press section 105 includes a press frame cabinet 109 in which a bed unit 139 and a slide unit 141 are disposed. The above detected output converter 133 is connected to a feed operation controller 137 in the adjustment and arithmetic operation unit 135. Note that, in FIG. 9, the bed unit 139, the slide unit 141 and a shut height adjustment unit are shown outside of the press frame cabinet 109 for the convenience of explanation. Although not shown, the bed unit 139 includes lower die components (first die components) and the upper slide unit 141 includes upper die components (second die components). Then, a shut height H is prescribed by the bed unit 139 and the slide unit 141. The slide unit 141 is driven upward and downward by a hydraulic motor 143, whereby the shut height H is changed.

The raw material (not shown) is struck (pressed) between the upper die components and the lower die components and forged to have a thickness and a weight in accordance with the shut height H.

Incidentally, when the striking is continuously carried out in the forging press section 105, the die components, a die holder (press frame) and the like are thermally expanded by the heat generated in the striking. As a result, the weight, thickness and the like of a forged product is deviated from predetermined values. That is, the accuracy of the forged product is deteriorated. The deterioration of the accuracy adversely affects the cooling of the die components effected by a lubricator, the stop time of the die components (radiation time) when the press is stopped and further the preheat of the die components and the wear and the like thereof. Accordingly, the accuracy of forged products is varied very complicatedly.

According to the experiment and the like performed by the inventors, it has been found that variation of the accuracy of forged products (weight and thickness) correlates with a load in striking. That is, when a raw material W is struck in a certain state during continuous striking, there is a correlation between the loads (striking loads) imposed on the bed unit 139 and the slide unit 141 and the accuracy of a forged product. In addition, when striking is carried out without a raw material just after a press operation is resumed after the stop thereof, there is a correlation between the loads imposed on the bed unit 139 and the slide unit 141 (hereinafter, referred to die-kiss loads) and the accuracy of a forged product.

In the forging press apparatus of the embodiment of the present invention, the shut height controller includes a load sensor converter 145 and a shut height controller 147 in the adjustment and arithmetic operation unit 135. As shown in the figure, load sensors (for example, strain gauges) 153 and 155 are disposed on the support columns 149 and 151 of the press frame cabinet 109 and coupled with the load sensor converter 145, respectively.

The load sensor converter 145 is connected to the shut height controller 147 in the adjustment and arithmetic operation unit 135. A press position detector 159 is connected to the shut height controller 147 through a timing determination unit 157, and further a position sensor (encoder) 171 for detecting the position of the slide unit 141 is connected to the shut height controller 147. Then, the shut height controller 147 issues a hydraulic motor drive command signal as described below and drives the slide unit 141, thereby adjusting the shut height H.

Figure 10:
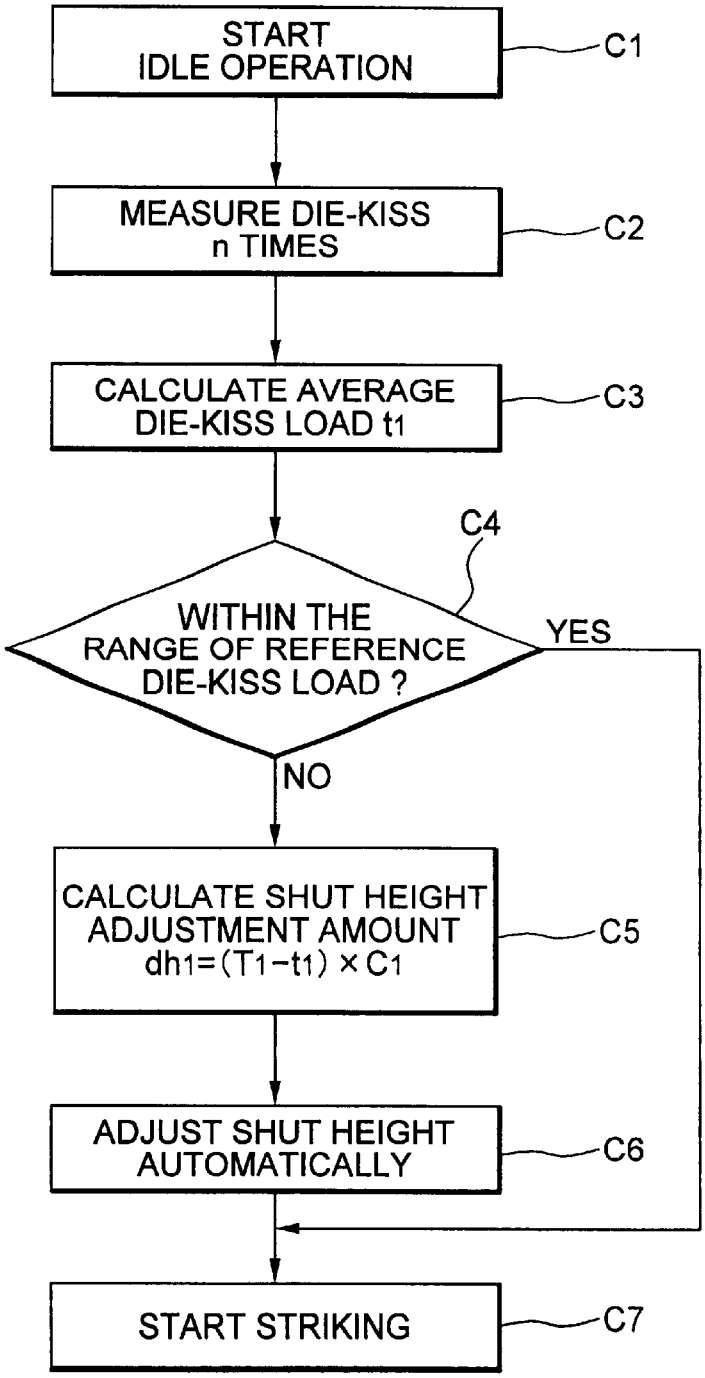
FIG. 10 is a flowchart explaining the adjustment of a shut height when press operation is started.
Figure 11:
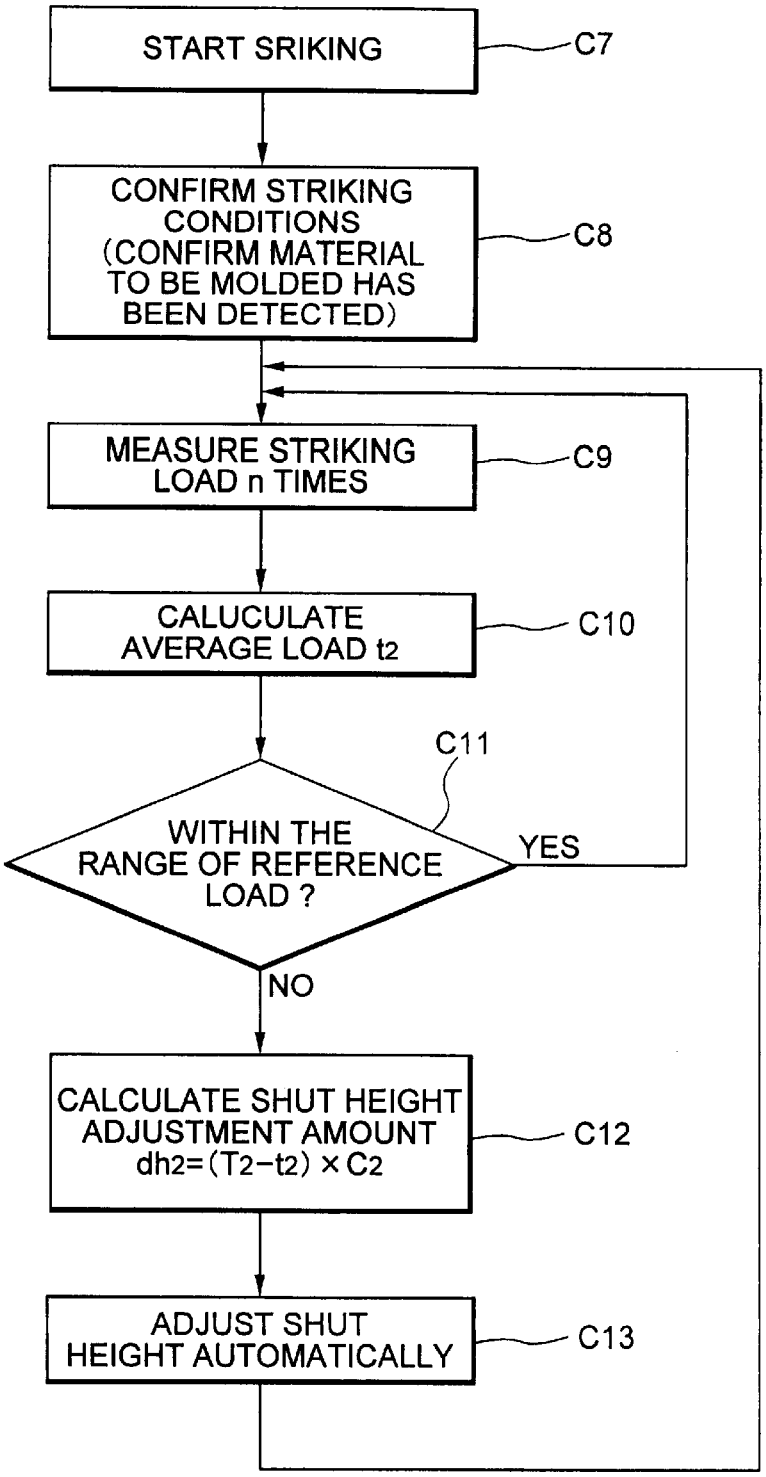
FIG. 11 is a flowchart explaining the adjustment of the shut height in continuous striking.

Referring to FIGS. 10 and 11, how the shut height H is adjusted at the start of the press operation will be specifically described.

At the start of the press operation, the press is always operated without a raw material charged into the die components (this operation is called idling, step; C1). When striking is carried out without the raw material, the lower die components of the bed unit 139 comes into contact with the upper die components of the slide unit 141. Then, the press frame cabinet 109 is distorted in accordance with the load in striking. That is, since the press frame cabinet 109 is distorted in accordance with the loads imposed on the bed unit 139 and the slide unit 141, the loads (die-kiss load) imposed on the bed unit 139 and the slide unit 141 can be determined by measuring the amounts of distortion of the press frame cabinet 109.

The amount of distortion of the frame when the striking is carried out without the raw material (idling) is measured by the strain gauges 153 and 155 and supplied to the load sensor converter 145 as distortion signals, respectively. These distortion signals are amplified by amplifiers 161 and 163, respectively and converted into a multiple-signal by a multiplexer 165. The multiple-signal is converted into a digital signal by an A/D converter 167 and supplied to the shut height controller 147 having a CPU. The relationship between an amount of distortion and a load (die-kiss load) is preset in the shut height controller 147. The shut height controller 147 calculates a die-kiss load in response to the digital signal and stores the die-kiss load in a memory 169 as a measured die-kiss load (die-kiss load data). The die-kiss load is measured n time (n is an integer of at least 2) after the start of the idling as described above (step SB2). Next, first to n-th die-kiss load data is supplied to the shut height controller 147 and stored in the memory 169.

The shut height controller 147 determines an average die-kiss load t1 by averaging the first to n-th die-kiss load data stored in the memory 169 (step C2). A preset reference die-kiss load (a load according to a preset reference shut height) T1 is given, and the shut height controller 147 compares the average die-kiss load t1 with the reference die-kiss load T1 and determines the deviation (T1−t1) therebetween (step C4). When the absolute value of (T1−t1) exceeds a preset allowable value TC1 {absolute value (T1−t1)>allowable value TC1}, the shut height controller 147 calculates a shut height adjustment value dh1. Specifically, the shut height controller 147 determines dh1=(T1−t1) ×C1 (step C5), where C1 is a predetermined constant.

The detected press position detected by the press position sensor 159 is supplied to the timing determination unit 157. Then, the timing determination unit 157 determines whether it is possible to adjust the shut height or not based on the detected press position. When the adjustment is possible, the timing determination unit 157 issues a shut height adjustment permission signal to the shut height controller 147. The shut height controller 147 issues a hydraulic motor drive command signal to the hydraulic motor 143 to thereby drive the slide unit 141 (in this case, when dhe1 is negative, the slide unit 141 is driven downward, whereas when dh1 is positive, the slide unit 141 is driven upward). At the time, the amount of movement of the slide unit 141 is detected by the encoder 171 and fed back to the shut height controller 147. When the detected amount of movement of the slide unit 141 reaches the shut height adjustment value dh1, the shut height controller 147 stops the hydraulic motor 143 and completes the correction of the shut height H (step C6).

On the completion of the correction of the shut height H, the shut height controller 147 permits a raw material to be charged into the die component, whereby by the press of the raw material is started as described below (step C7).

In contrast, the absolute value of (T1−t1) is equal to or less than the allowable value TC1 {absolute value (T1−t1) ≦allowable value TC1}, the adjustment and arithmetic operation unit 135 executes step C7.

When the press of the raw material is permitted as described above, the raw material is charged into the die component and striking is performed.

Referring to FIG. 11, when the striking is started (step C7) and the raw material is struck in a certain state, the press frame is slightly expanded by the reaction force of the raw material and an interval is made between the die components. The press frame cabinet 109 is also distorted according to a load in the striking, and the amounts of distortion of the frame are measured by the strain gauges 153 and 155 and supplied to the load sensor converter 145 as distortion signals, respectively. These distortion signals are amplified by the amplifiers 161 and 163, respectively and converted into a multiple-signal by the multiplexer 165. The multiple-signal is converted into a digital signal by the A/D converter 167 and supplied to the adjustment and arithmetic operation unit 135 (step C8). In the shut height controller 147, the data indicating the relationship between an amount of distortion and a striking load (load in the state that a raw material is charged) is previously stored in the memory 169. The shut height controller 147 calculates a striking load in response to the digital signal from the data stored in the memory 169. The striking load is stored in the memory 169 again as a measured striking load (striking load data). As described above, after the start of the actual striking, striking load is measured n times (step C9). That is, first to n-th striking load data is stored in the memory 169 from the shut height controller 147.

Next, the shut height controller 147 reads the first to n-th striking load data from the memory 169 and averages it to thereby determine an average striking load t2 (step SB10). Further, a preset reference striking load (a load according to a reference shut height in striking) T2 is given to the shut height controller 147, and the shut height controller 147 compares the average striking load t2 with the reference striking load T2 and determines the deviation (T2−t2) therebetween (step SB11).

When the absolute value of (T2−t2) exceeds a preset allowable value TC2 {absolute value of (T2−t2)>allowable value TC2}, the shut height controller 147 calculates a shut height adjustment amount dh2. Specifically, the shut height controller 147 determines dh2=(T2−t2)×C2(step C12), where C2 is a predetermined constant.

As described above, when the shut height controller 147 receives a shut height adjustment permission signal from the timing determination unit 157, it issues a hydraulic motor drive command signal to the hydraulic motor 143 and drives the slide unit 141 (in this case, when dh2 is negative, the slide unit 141 is driven downward, whereas when dh2 is positive, the slide unit 141 is driven upward). At the time, when the detected amount of movement of the slide unit 141 reaches the shut height adjustment amount dh2, the shut height controller 147 stops the hydraulic motor 143, whereby the correction of the shut height H is completed (step C13). Thereafter, step C9 is executed again.

In contrast, when the absolute value of (T2−t2) is equal to or less than an allowable value TG1 {absolute value of (T2−t2)≦allowable value TG2}, a CPU 15*a* executes step C9 again.

Note that when striking is temporarily stopped and started again, the striking is resumed after the shut height is adjusted based on the above reference die-kiss load.

Figure 12A:
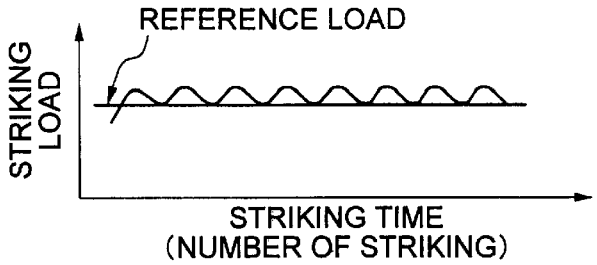
FIGS. 12A and 12B are graphs showing the relationship between a striking load and the thickness (weight) of a forged product when the shut height adjustment control is carried out.
Figure 12B:
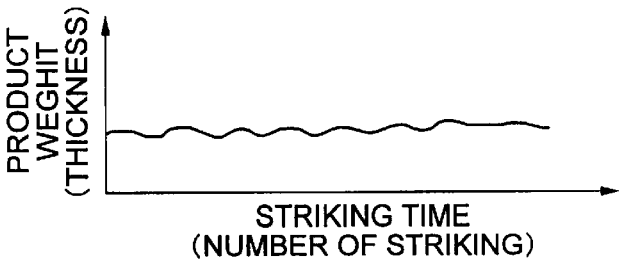
Figure 13A:
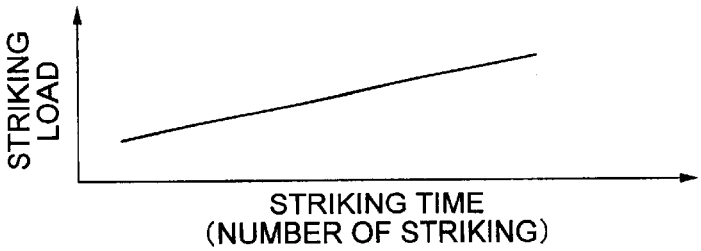
FIGS. 13A and 13B are graphs showing the relationship between a striking load and the thickness (weight) of a forged product when no shut height adjustment control is carried out.
Figure 13B:
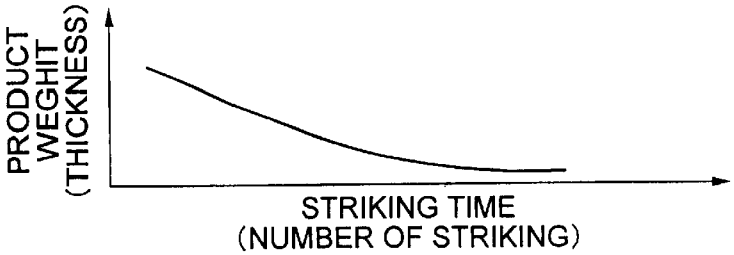

When the striking is carried out as described above, the striking load is only slightly varied in the vicinity of the reference striking load as shown in FIGS. 12A and 12B with a result that both the thickness and weight of a forged product can be substantially in coincidence with predetermined reference values.

In contrast, when the shut height adjustment is not carried out, the striking load is increased as a striking time passes (FIG. 13A), and as a result, the thickness and weight of a forged product are reduced as a time passes (FIG. 13B) so that the accuracy of the forged product cannot be maintained.

As described above, in the second embodiment of the present invention, since the shut height adjustment is carried out also at the start of striking based on the reference die-kiss load, the striking load can be corrected from the beginning of striking based on the variation of the thermal expansion of the die components, die holder and the like so that a forged product having high accuracy can be obtained from the start of the striking.

As described above, according to the second embodiment of the present invention, when the supply of a raw material to the inlet side transportation device is delayed due to the deviation between the cycle time of the heating furnace and that of the forging press, since the transfer feeder is temporarily stopped and the occurrence of partial lack of the raw materials between the multi-process die components in the forging press is prevented, the reduction of productivity and the occurrence of defective products can be minimized.

In other words, in the second embodiment of the present invention, even if the cycle of the heating furnace is a little badly synchronized with the cycle of the forging press, the partial lack of raw materials can be prevented and productivity can be enhanced.

Further, in the second embodiment of the present invention, since the shut height is adjusted based on the reference die-kiss load at the beginning of striking, a forged product of good accuracy can be obtained from the beginning of the striking. Moreover, since an amount of correction of the shut height can be calculated only by measuring striking loads, there can be obtained an effect that the embodiment can be arranged simply and further the shut height can be adjusted with pinpoint accuracy.

What is claimed is:

1. A forging press apparatus including a forging press section, an automation means for supplying a raw material to the forging press section, a heating furnace, and an inlet side transportation device for transporting the raw material heated by the heating furnace to the automation means, wherein:

the inlet side transportation device comprises a raw material detector for detecting whether the raw material to be supplied to the automation means has been supplied or not and a controller for controlling the feed operation of the automation means;

said controller causing the automation means to perform an ordinary feed operation when said controller receives a detection signal indicating that the raw material is supplied from said detector, and said controller temporarily stopping the automation means at a waiting position when said controller does not receive the detection signal from said detector; and said controller starting the automation means when said controller receives a detection signal of a raw material supplied next within the set time of the temporary stop, and controller starting the automation means simultaneously with the finish of the set time when said controller does not receive the detection signal of the raw material within the set time.

2. A forging press apparatus according to claim 1, wherein the forging press section molds the raw material to a forged product by continuously striking the raw material in die components.

3. A forging press apparatus according to claim 1, wherein said controller is composed of a feed operation control means and the forging press section comprises a shut height control means for controlling the thickness of the forged product;

said shut height control means comprising a measurement means for obtaining a measured striking load by continuously measuring striking loads in the state that the raw material is charged into the die components and an adjustment means for comparing a predetermined reference striking load with the measured striking load and determining a deviation therebetween, and also adjusting a shut height based on a shut height correction value corresponding to the deviation when the deviation exceeds a predetermined allowable value.

4. A controller of an automation means in a forging press apparatus including a forging press section, the automation means for supplying a raw material to the forging press section, a heating furnace, and inlet side transportation device for transporting the raw material heated by the heating furnace to the automation means, wherein:

the inlet side transportation device comprises a raw material detector for detecting whether the raw material to be supplied to the automation means has been supplied or not and the controller for controlling the feed operation of the automation means;

the controller causing the automation means to perform an ordinary feed operation when the controller receives a detection signal indicating that the raw material is supplied from said detector, and controller temporarily stopping the automation means at a waiting position when the controller does not receive the detection signal from said detector;

the controller starts the automation means when the controller receives a detection signal of a raw material supplied next within the set time of the temporary stop, and the controller starting the automation means simultaneously with the finish of the set time when the controller does not receive the detection signal of the raw material within the set time.

5. The controller according to claim 4, the controller being further provided to control a shut height of the forging press apparatus, the forging press section being for forging a raw material to a forged product by continuously forging the raw material by die components, wherein:

the forging press section comprises a shut height means for controlling the thickness of the forged product;

said shut height control means comprising a measurement means for obtaining a measured striking load by continuously measuring a striking load in the state that the raw material is charged into the die components and an adjustment means for comparing a predetermined reference striking load with the measured striking load and determining a deviation therebetween, and also adjusting a shut height based on a shut height correction value corresponding to the deviation when the deviation exceeds a predetermined allowable value.

* * * * *